US007878634B2

(12) United States Patent
Kersey et al.

(10) Patent No.: US 7,878,634 B2
(45) Date of Patent: Feb. 1, 2011

(54) WASTE INK COLLECTION SYSTEM

(75) Inventors: Kevin T. Kersey, San Diego, CA (US); Geoffrey Schmid, San Diego, CA (US); Alan Joseph Senior, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 910 days.

(21) Appl. No.: 11/741,430

(22) Filed: Apr. 27, 2007

(65) Prior Publication Data

US 2008/0266366 A1 Oct. 30, 2008

(51) Int. Cl.
*B41J 2/175* (2006.01)
*B41J 2/18* (2006.01)
*B41J 2/165* (2006.01)

(52) U.S. Cl. ..... 347/85; 347/22; 347/28; 347/89

(58) Field of Classification Search ..... 347/85, 347/22, 28, 73, 84, 89, 90
See application file for complete search history.

(56) References Cited

U.S. PATENT DOCUMENTS 6,203,138 B1 3/2001 Hirabayashi et al.
6,250,736 B1 6/2001 Wojcik
6,406,122 B1 * 6/2002 Sharma et al. ..... 347/28
6,783,221 B2 8/2004 Phillips
2003/0016264 A1 * 1/2003 Jeanmaire ..... 347/28
2004/0075712 A1 4/2004 Ono
2004/0100521 A1 5/2004 Rotering
2004/0114006 A1 6/2004 Phillips
2005/0285917 A1 12/2005 Nichols et al.
2006/0061620 A1 3/2006 Tani et al.
2007/0008372 A1 1/2007 Katada

FOREIGN PATENT DOCUMENTS

DE 19957576 C1 6/2001
GB 2339170 A 1/2000

* cited by examiner

*Primary Examiner*—Uyen-Chau N Le
*Assistant Examiner*—Kajli Prince

(57) ABSTRACT

An ink collection system includes at least one target surface and a fluid supply system in communication with the at least one target surface. The fluid supply system is configured to create a film of fluid across at least a portion of the at least one target surface, and wherein the film of fluid flushes away ink that impinges on the at least one target surface.

21 Claims, 6 Drawing Sheets

WASTE INK COLLECTION SYSTEM

BACKGROUND

Inkjet printers include printhead assemblies having one or more printheads that operate by ejecting drops of ink onto a print medium through a plurality of printhead nozzles. Modern inkjet printers are capable of producing printed images onto a plurality of media types, including full-bleed (i.e., borderless) photos. When printing borderless photos, inkjet printers actually print an image that is larger than the target media (e.g., paper), which causes an overspray of waste ink around the perimeter of the paper. Inkjet printers also generate waste ink by purging the printhead nozzles prior to printing an image to ensure that the nozzles are clear. If not properly managed and disposed of, waste ink can cause a number of printing problems including clogged printhead nozzles and reduced print quality.

In known printer configurations, waste ink is often captured using absorbent pads made from fiber or open cell foam, which draws the ink away from the top surface of the pads. Although effective for absorbing waste ink, the pads have a limited volume of ink that can be absorbed. In addition, depending on environmental conditions and the type of ink being used, the ink does not always wick fully into the absorbent pad and can lead to a build up of stalagmites (generally conical deposits of build-up from ink drops) that further reduce the level of absorbency of the pads and contribute to print problems.

Further, the absorbent pads must generally be positioned just beneath the paper to prevent the velocity of the ink from slowing to a point where the ink droplets turn into an aerosol, which interferes with the functionality of the printhead components as well as the overall quality of the printed image. To prevent this, the absorbent pads must generally be captured within a few millimeters (approximately 5 mm) of the printhead surface. The close proximity of the pad with respect to the printhead assembly limits the size of the pad and increases the risk of stalagmite build up that clogs the printhead nozzles.

In other known printer configurations, overspray trays are used to capture waste ink. In some cases, overspray trays are more advantageous than absorbent pads in that the capacity of the trays is not limited by the absorbent volume of the pads. However, like the absorbent pads, overspray trays must be mounted in close proximity to the printhead surface to prevent the ink from turning into an aerosol. As a result, overspray trays generally have a raised collection surface for receiving waste ink droplets. However, to be effective in removing waste ink, the ink droplets must drip down into the bottom of the tray. This approach works well with some inks, but not with others. For example, pigmented inks, especially in hot or dry environments, do not generally flow well and can quickly build up stalagmites on the raised collection surface. Moreover, replacing overspray trays is often undesirable because they are generally open at the top and filled with waste ink that is likely to spill when moved or tipped.

Finally, another method used in some inkjet printers is to avoid collection and removal of waste ink all together by providing a larger paper size and trimming off the edges to obtain a borderless photo. In this way, waste ink is simply absorbed by the extra paper and discarded. Unfortunately, this method greatly increases the cost of the printer by requiring a paper cutting mechanism and produces a significant amount of paper waste.

Accordingly, the embodiments described hereinafter were developed in light of these and other drawbacks associated with known waste ink collection systems.

DETAILED DESCRIPTION

A system and method for collecting waste ink is provided. The system includes at least one target platform fluidically connected to a fluid reservoir through a supply line and a return line. Through the supply line the reservoir supplies fluid to the target platform creating a film of fluid across at least a portion of the target platform. The film of fluid serves to flush away any ink that impinges upon the surface of the target platform. The fluid is then collected in a gutter and routed back to the reservoir through the return liner completing a closed-loop configuration. In one embodiment, the fluid becomes a mixture of fluid and ink that is continuously circulated through the system until the fluid in the reservoir becomes overly saturated with ink, or the level of the fluid/ink mixture exceeds the capacity of the reservoir. In another embodiment, the flow of fluid through the system is an intermittent, single flush system wherein a clean fluid is periodically flushed through the reservoir.

Figure 1:
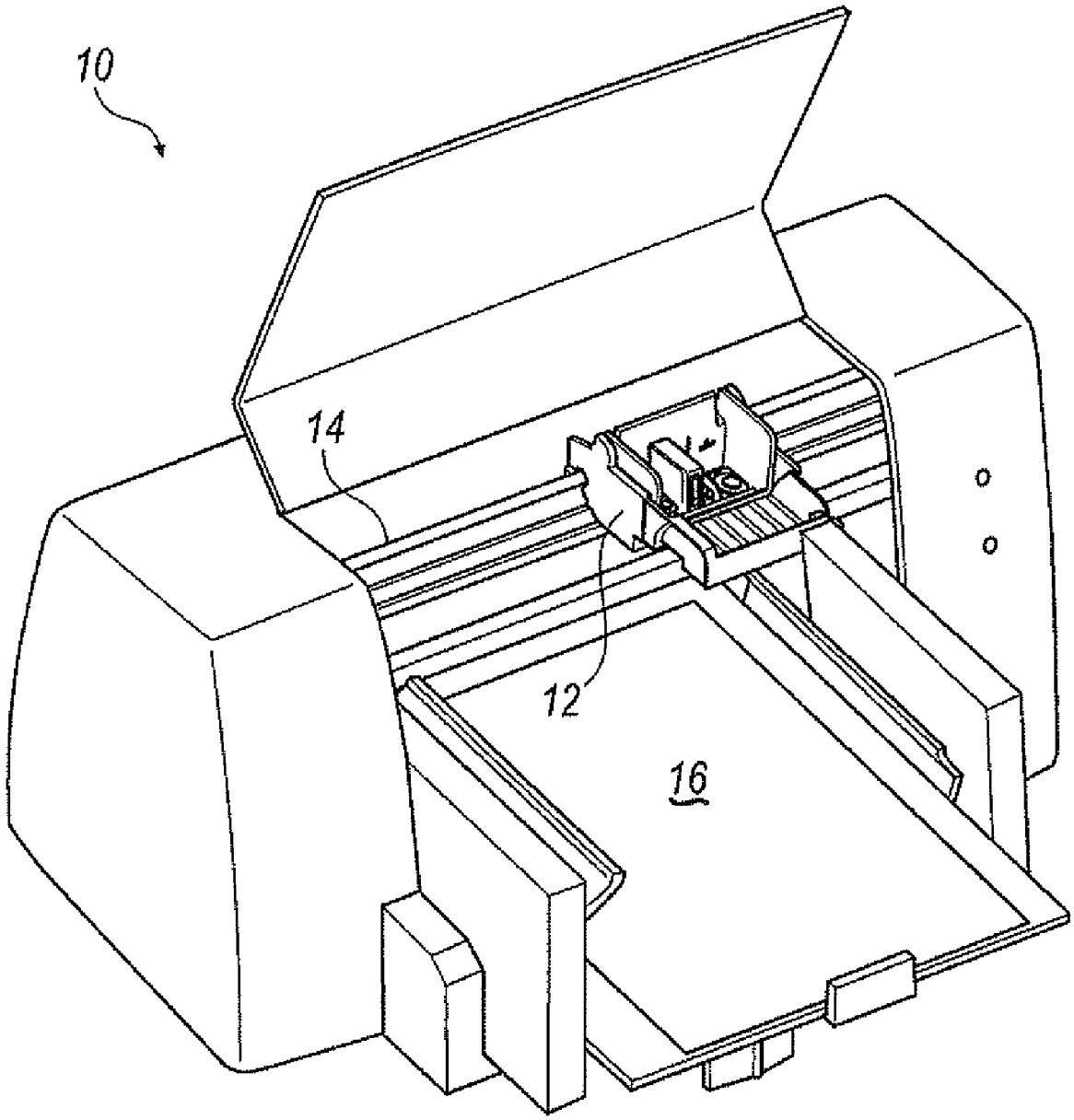
FIG. 1 illustrates an exemplary inkjet printer, according to an embodiment.

FIG. 1 illustrates an exemplary inkjet printer 10 having at least one printhead assembly 12 mounted to a scanning carriage 14. The printhead assembly 12 selectively ejects drops of ink onto a printing medium, such as paper 16, as the carriage 14 traverses a carriage rod 16 from one side of the printer 10 to the other in a bidirectional fashion. As known by one of ordinary skill in the art, the inkjet printer 10 shown in FIG. 1 is exemplary and in no way limits the application of the disclosed waste ink collection system. For example, in contrast to the inkjet printer 10 shown in FIG. 1, some inkjet printers are configured such that the print medium moves along a print axis and the printhead assembly remains stationary. In any case, the disclosed waste ink collection system can be applied to any suitable printer configuration.

Figure 2:
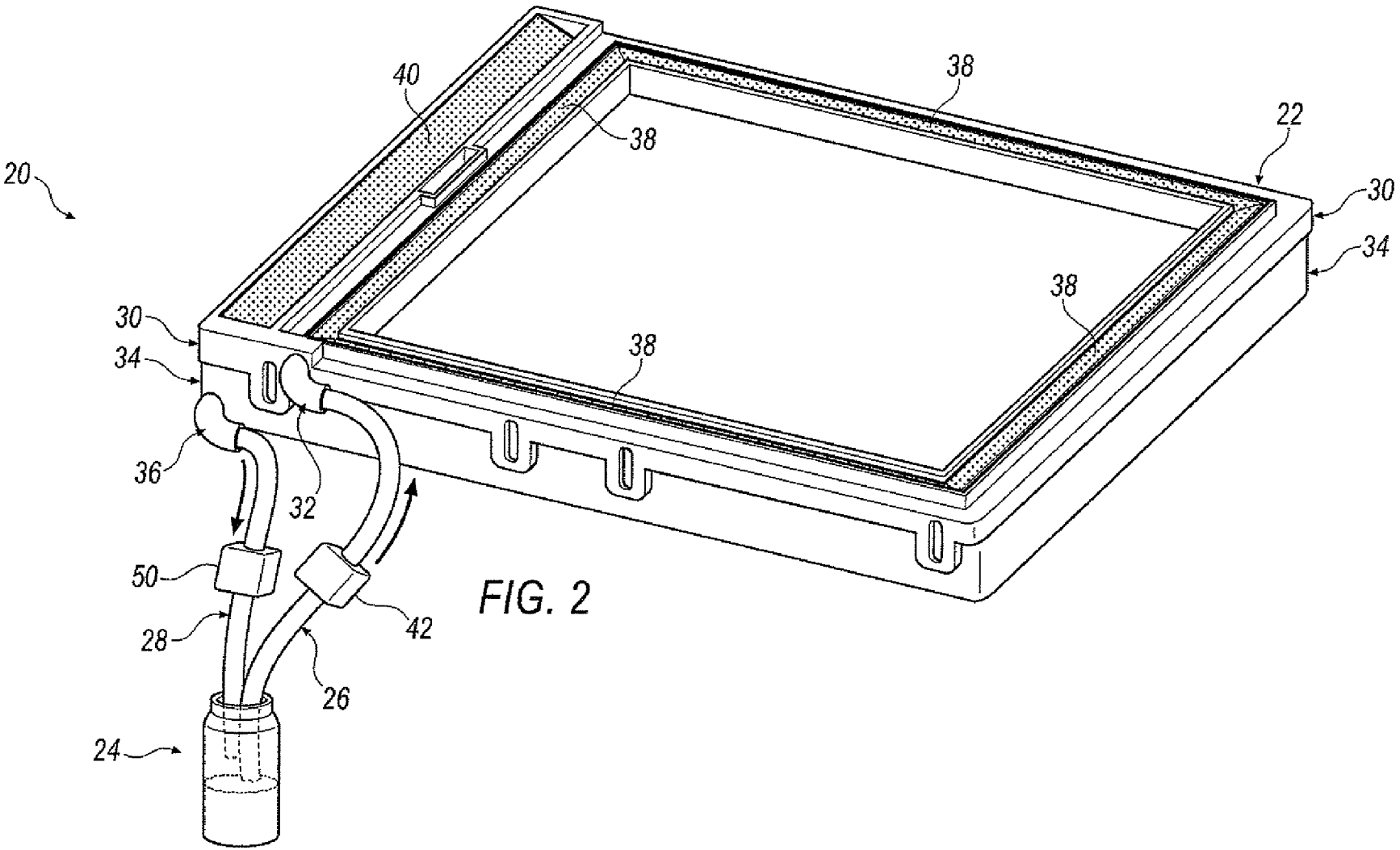
FIG. 2 illustrates an exemplary waste ink collection system, according to an embodiment.

FIG. 2 illustrates an exemplary waste ink collection system 20 having a collection tray 22 in fluid communication with a reservoir 24 through a supply line 26 and a return line 28. The fluid from reservoir 24 may be water, or a combination of water and an additive. For example, adding polyethylene glycol (PEG) may help minimize foaming and/or splashing, while other additives may be added to suspend waste ink pigments within the fluid, making them easier to carry away. Such additives may depend upon the type of ink used in printer 10. Additives may also increase the viscosity of the fluid, and also decrease the rate of evaporation.

Supply line 26 provides fluid from reservoir 24 to an upper portion 30 of collection tray 22 through an inlet port 32. A fluid return path to reservoir 24 using return line 28 originates from a lower portion 34 of collection tray 22 through an outlet port 36. In this way, waste ink collection system 20 provides a closed-loop system that circulates fluid between reservoir 24 and the collection tray 22.

The upper portion 30 of collection tray 22 includes a target platform 38 that substantially frames the perimeter of collection tray 22. The target platform 38 serves as an initial deposit surface for waste ink that is oversprayed from printhead assembly 12. The upper portion 30 of collection tray 22 further includes a spitting plate 40 for capturing waste ink that is purged from the printhead nozzles during a cleaning process or when ink is expelled from the nozzles prior to a particular print job. Both the spitting plate 40 and the target platform 38 are, in one embodiment, made from a porous plastic or fiber material that is permeable to the fluid in reservoir 24.

Figure 3:
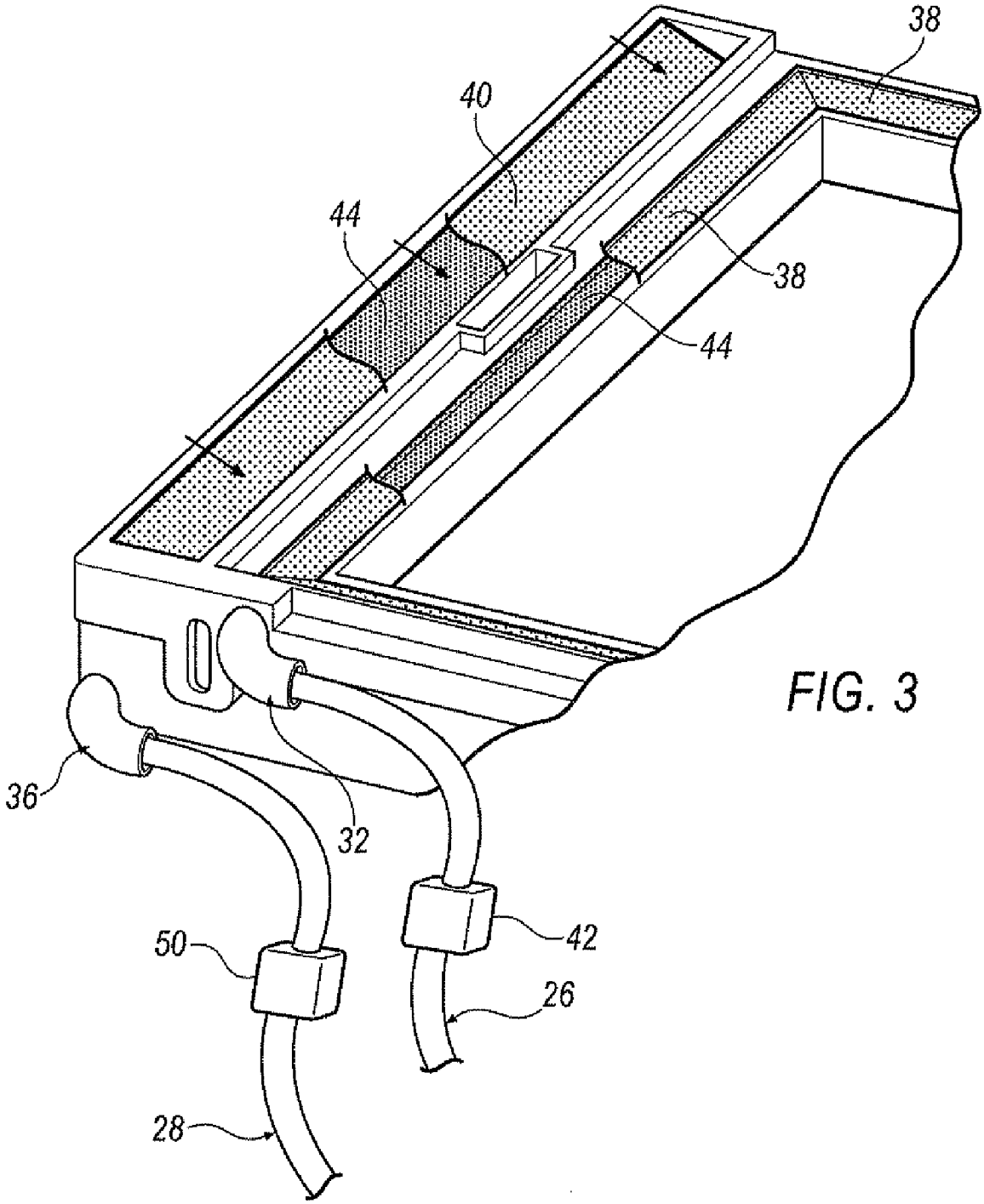
FIG. 3 illustrates the exemplary waste ink collection system of FIG. 2, according to an embodiment.

As shown in FIG. 2, waste ink collection system 20 further includes a supply pump 42, which supplies fluid from reservoir 24 to collection tray 22, and ultimately, to target platform 38 and spitting plate 40. As best shown in FIG. 3, the fluid supplied to target platform 38 and spitting plate 40 is pressurized and delivered through a plenum 44 mounted below the target platform 38 and spitting plate 40. Being porous, the fluid penetrates through to the top surfaces of target platform 38 and spitting plate 40 creating a flow or film of fluid thereon. In this way, impinging waste ink is flushed away by the film of fluid that flows across the surfaces of the platform 38 and spitting plate 40, and into the lower portion 34 of collection tray 22.

Figure 4:
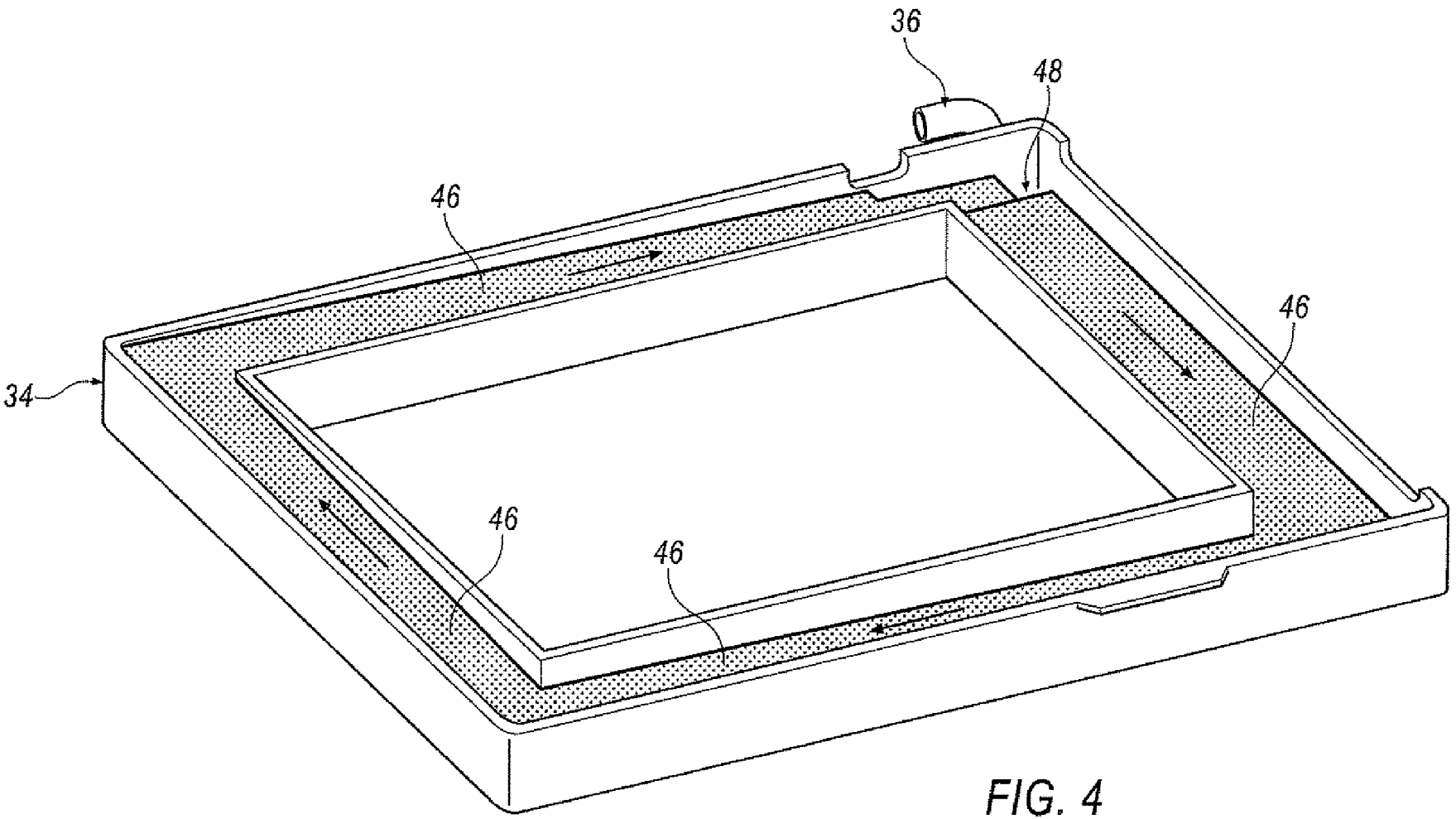
FIG. 4 illustrates an exemplary lower portion of the exemplary waste ink collection system of FIG. 2, according to another embodiment.

FIG. 4 illustrates an exemplary lower portion 34 of collection tray 22 that includes gutters or drainage channels 46 for collecting and channeling fluid from target platform 38 and spitting plate 40 to reservoir 24. In one embodiment, the bottom surface of gutters 46 is contoured with downward angles that assist in directing the fluid into a collection sump 48 where the fluid is suctioned, either by gravity or a return pump 50 (shown in FIGS. 2 and 3), to reservoir 24 through return line 28.

As waste ink collection system 20 continues to run and capture more waste ink, the fluid in reservoir 24 becomes increasingly contaminated with ink and the overall level of fluid in reservoir 24 rises. At some point, either reservoir 24 will be full, or the ink concentration will be at a practical saturation limit, each of which will require replacement of reservoir 24. Although reservoir 24 may be mounted within the enclosure of printer 10, it is generally remotely mounted from the print zone, which allows the size of the reservoir 24 to be arbitrarily large. In one embodiment, reservoir 24 includes a sensing mechanism (not shown) to detect the level of ink and/or the level of saturation in the ink. The sensing mechanism can include any suitable sensing means, including but not limited to, optical, ultrasonic or weight measurement techniques.

Figure 5:
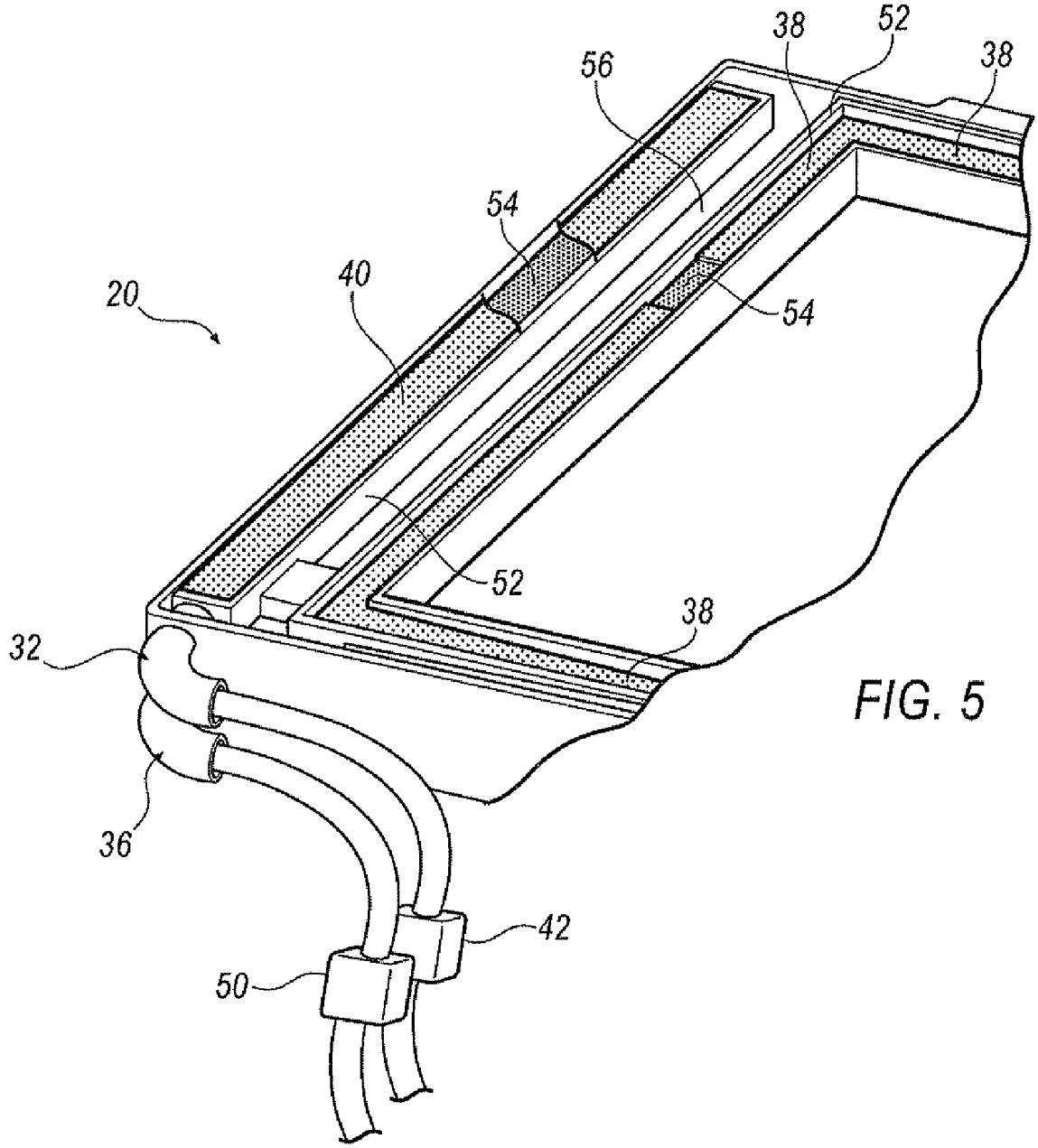
FIG. 5 illustrates another exemplary waste ink collection system, according to another embodiment.

As shown in FIG. 2, target platform 38 and spitting plate 40 are mounted at approximately 45 degree angles. In this configuration, the film of fluid flows downward into gutters 46 in lower portion 34. In another embodiment, as shown in FIG. 5, target platform 38 and spitting plate 40 are mounted horizontally with a raised outer ridge 52 that creates a determined depth of fluid above the surface of the platform 38 and spitting plate 40. The collection tray in this configuration receives pressurized fluid from a plenum 54, which penetrates porous platform 38 and spitting plate 40 to create a flow of fluid on the surfaces of the platform 38 and spitting plate 40. In this case, however, the fluid builds on the surface of the platform 38 and spitting plate 40 and eventually rises over the edge of the ridge 52 into an integrated gutter system 56. In other words, rather than having a collection tray with an upper and a lower portion as shown in FIG. 2, the collection tray of FIG. 4 is a single tray structure wherein the ink target surfaces (i.e., the target platform 38 and the spitting plate 40) are integrated with gutter system 56.

Figure 6:
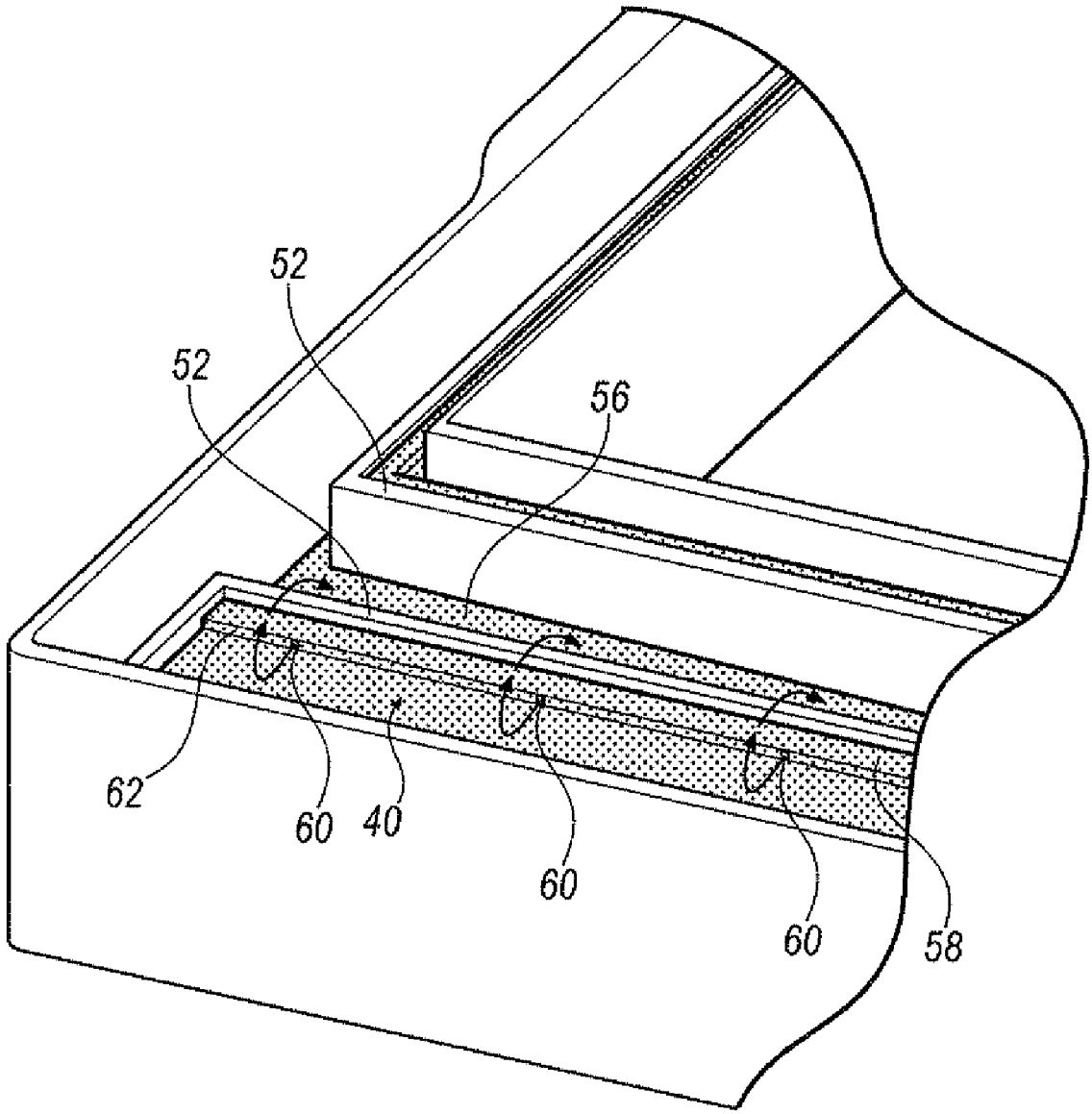
FIG. 6 illustrates another exemplary waste ink collection system, according to another embodiment.

FIG. 6 illustrates another variation of the waste ink collection tray shown in FIG. 5, wherein the target platform 38 and the spitting plate 40 are made from a solid material, such as molded plastic, and include a step 58 having pin-like holes 60 in a vertical side surface 62. Like the previous embodiments, pressurized fluid is supplied from beneath the target platform 38 and spitting plate 40, but rather than penetrating therethrough, the fluid flows on the surface of the platform and plate through pin holes 60. The fluid flow from the pin holes 60 flushes away any ink impinging on the surface of the platform 38 and spitting plate 40, mixing the ink with the fluid, which ultimately rises above ridge 52 into integrated gutter system 56.

It is to be understood that the above description is intended to be illustrative and not restrictive. Many embodiments and applications other than the examples provided would be apparent to those skilled in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

We claim:

1. An ink collection system, comprising:

an ink collection tray having at least one target surface for receiving ink ejected by a printhead, said target surface arranged around an opening in said tray sized to frame a piece of print medium that is also receiving ink ejected by said printhead; and a fluid supply system in communication with said at least one target surface, said fluid supply system being configured to create a film of fluid across at least a portion of said at least one target surface, and wherein said film of fluid flushes away ink that impinges on said at least one target surface.

2. The ink collection system of claim 1, wherein said fluid supply system includes a reservoir in fluid communication with said at least one target surface through a supply line.

3. The ink collection system of claim 2, wherein said fluid supply system further includes a return line fluidically connected between said at least one target surface and said reservoir.

4. The ink collection system of claim 3, wherein said fluid supply system is configured to be a closed-loop fluid system wherein fluid is supplied from said reservoir to said at least one target surface through said supply line to create said film of fluid, and wherein said film of fluid flushes the received ink from said at least one target surface to said reservoir through said return line.

5. The ink collection system of claim 4, wherein said fluid supply system further includes a first pump to supply fluid from said reservoir to said at least one target surface through said supply line.

6. The ink collection system of claim 1, further comprising a gutter connected to said at least one target surface and configured to receive said fluid.

7. The ink collection system of claim 6, wherein a bottom surface of said gutter is contoured with downward angles so that said fluid flows to said return line.

8. The ink collection system of claim 7, wherein said gutter further includes a recess for collecting said fluid.

9. The ink collection system of claim 6, wherein said fluid supply system further includes a second pump for extracting fluid from said gutter into said reservoir through said return line.

10. The ink collection system of claim 1, wherein said at least one target surface is angled.

11. The ink collection system of claim 1, wherein said at least one target surface is substantially horizontal.

12. The ink collection system of claim 1, wherein said at least one target surface is porous.

13. The ink collection system of claim 12, wherein said fluid is supplied to said at least one target surface through a plenum.

14. The ink collection system of claim 1, wherein said at least one target surface is a solid material and further includes a step with a plurality of pin holes for supplying said fluid to said at least one target surface.

15. A waste ink collection system, comprising:

a fluid reservoir; and an ink collection tray in fluid communication with said fluid reservoir, said ink collection tray arranged opposite a printhead and having a target platform with a plurality of adjacent drainage channels, said reservoir being configured to supply fluid to said target platform creating a film of fluid across at least a portion of said target platform;

wherein ink ejected from said printhead and impinging on a surface of said target platform is flushed to said plurality of adjacent drainage channels by said film of fluid.

16. The waste ink collection system of claim 15, wherein said ink collection tray further includes a spitting plate in fluid communication with said reservoir, wherein said reservoir is configured to supply fluid to said spitting plate creating a film of fluid across at least a portion of said spitting plate.

17. The waste in collection system of claim 16, wherein ink impinging on a surface of said spitting plate is flushed to said plurality of adjacent drainage channels by said film of fluid.

18. An inkjet printer, comprising:

at least one printhead configured to eject ink onto a print medium;

an ink collection tray having a top portion and a bottom portion, said top portion including a target platform configured to receive waste ink from said printhead;

a reservoir in fluid communication with said ink collection tray, wherein fluid from said reservoir is supplied to said target platform creating a film of fluid across at least a portion of said target platform;

wherein waste ink impinging on a surface of said target platform is flushed away by said film of fluid to said bottom portion of said ink collection tray.

19. The inkjet printer of claim 18, wherein said bottom portion of said ink collection tray includes a gutter configured to route said fluid to said reservoir.

20. The inkjet printer of claim 18, wherein said fluid is supplied from said reservoir to said top portion of said ink collection tray through a supply line.

21. The inkjet printer of claim 19, wherein said fluid is routed from said gutter to said reservoir through a return line.

* * * * *